US008205678B1

(12) United States Patent
Milanovich

(10) Patent No.: US 8,205,678 B1
(45) Date of Patent: Jun. 26, 2012

(54) BLOWOUT PREVENTER WITH A BERNOULLI EFFECT SUCK-DOWN VALVE

(76) Inventor: Philip John Milanovich, Phoenix, AZ (US)

( * ) Notice: Subject to any disclaimer, the term of this patent is extended or adjusted under 35 U.S.C. 154(b) by 0 days.

(21) Appl. No.: 12/960,495

(22) Filed: Dec. 4, 2010

(51) Int. Cl.
*E21B 43/01* (2006.01)

(52) U.S. Cl. ..... 166/364; 166/339; 166/343; 166/344; 166/367; 166/85.4; 405/158

(58) Field of Classification Search ..... 166/364, 166/338, 339, 341, 343–345, 351, 367–372, 166/381, 85.1, 85.4, 85.5; 405/52, 158
See application file for complete search history.

(56) References Cited

U.S. PATENT DOCUMENTS 1,543,456 A * 6/1925 Stirling ..... 166/88.1
3,980,138 A * 9/1976 Knopik ..... 166/370
4,220,207 A * 9/1980 Allen ..... 166/367
4,301,827 A * 11/1981 Murthy et al. ..... 137/207
4,376,467 A * 3/1983 Allen ..... 175/7
4,440,523 A * 4/1984 Milgram et al. ..... 210/170.11
4,568,220 A * 2/1986 Hickey ..... 405/60
4,605,069 A * 8/1986 McClaflin et al. ..... 166/310
4,969,676 A * 11/1990 LaMagna ..... 294/64.3
5,012,854 A * 5/1991 Bond ..... 166/363
5,199,496 A * 4/1993 Redus et al. ..... 166/366
6,026,904 A * 2/2000 Burd et al. ..... 166/313
6,059,040 A * 5/2000 Levitan et al. ..... 166/372
6,119,779 A * 9/2000 Gipson et al. ..... 166/267
6,601,888 B2 * 8/2003 McIlwraith et al. ..... 294/64.3
7,987,903 B1 * 8/2011 Prado Garcia ..... 166/75.13
8,016,030 B1 * 9/2011 Prado Garcia ..... 166/75.13
2010/0171331 A1 * 7/2010 Jonas et al. ..... 294/64.3

* cited by examiner

*Primary Examiner* — Thomas Beach
*Assistant Examiner* — Matthew Buck
(74) *Attorney, Agent, or Firm* — Swift & Swift; Stephen Christopher Swift

(57) ABSTRACT

The present invention is a blowout preventer including a large frustoconical funnel, made of metal or other material. The large end of the funnel is placed over a well pipe (or other pipe) through which oil (or gas or other fluid) is blowing out. The small end of the funnel is connected to a return pipe. A high pressure pipe with a smaller diameter is inserted into the well pipe. Air is pumped under high pressure through the high pressure pipe, separating the oil and forcing the oil that is not kept down in the well pipe by the pressure up through the return pipe. The Bernoulli effect keeps the funnel on the well pipe. A gasket at the top end of the channel prevents leaks. Channels and rotating blades near the top of the funnel accelerate the flow, reducing pressure and increasing the suction due to the Bernoulli effect.

20 Claims, 8 Drawing Sheets

BLOWOUT PREVENTER WITH A BERNOULLI EFFECT SUCK-DOWN VALVE

BACKGROUND OF THE INVENTION

1. Field of the Invention

The present invention relates to apparatus and methods for preventing the escape of fluid from wells or pipes.

2. Description of the Prior Art

As shown by recent events in the Gulf of Mexico, oil well blowouts are a serious threat to the environment, and can be very costly. Current blowout preventers can be unreliable. While there are numerous prior inventions of blowout preventers, none are equivalent to the present invention.

U.S. Pat. No. 1,543,456, issued on Jun. 23, 1925, to Robert Stirling, discloses a blowout preventer, without the Bernoulli effect of the instant invention.

U.S. Pat. No. 4,301,827, issued on Nov. 24, 1981, to Rajam R. Murthy and Billy J. Rice, discloses a guided-float accumulator suitable for use with a hydraulic system for an oil well blowout preventer, using reaction forces that oppose Bernoulli effect forces, rather than making use of Bernoulli effect forces as in the instant invention.

U.S. Pat. No. 5,012,854, issued on May 7, 1991, to John A. Bond, discloses a pressure release valve for a subsea blowout preventer that is hydraulically operated, without making use of the Bernoulli effect as in the instant invention.

None of the above inventions and patents, taken either singly or in combination, is seen to describe the instant invention as claimed.

SUMMARY OF THE INVENTION

The present invention is a blowout preventer including a large frustoconical funnel or valve, made of metal or other suitable material. The large end of the funnel is placed over a well pipe (or other pipe) through which oil (or natural gas or other fluid) is blowing out. The small end of the funnel is connected to a return pipe. A high pressure pipe with a smaller diameter is inserted into the well pipe. Air is pumped under high pressure through the high pressure pipe, separating the oil and forcing the oil that is not kept down in the well pipe by the pressure up through the return pipe. The Bernoulli effect keeps the funnel on the well pipe. A gasket at the top end of the channel prevents leaks. Channels and rotating blades near the top of the funnel accelerate the flow, reducing pressure and increasing the suction due to the Bernoulli effect. This results in the sucking down of the funnel into the oil flowing from the pipe, as the increased velocity of the oil acts like the thrust of a ram jet, forcing the funnel down onto the well pipe. In underwater applications, the added pressure provided by the water to the outside of the funnel will also aid in the attachment of the funnel to the well pipe. At a depth of one mile below the surface of the sea, the water pressure is 2,300 to 2,500 pounds per square inch.

Accordingly, it is a principal object of the invention to prevent damage to the environment from oil well blowouts.

It is another object of the invention to prevent economic loss from nil well blowouts.

It is a further object of the invention to prevent damage to the environment from any kind of fluid escaping from a pipe.

Still another object of the invention is to prevent economic loss from any kind of fluid escaping from a pipe.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a blowout preventer that may be used with oil or gas wells, under the sea or on land.

Figure 1:
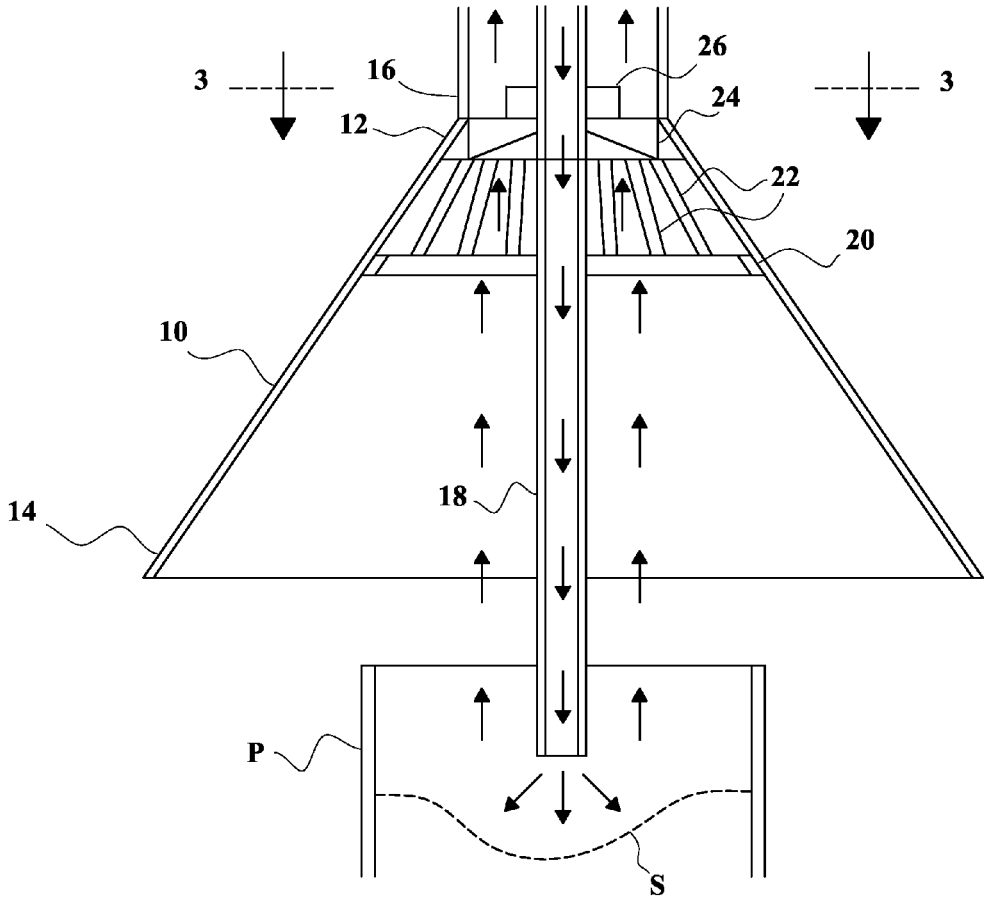
FIG. 1 is a vertical sectional view drawn along lines 1-1 of FIG. 3, showing the first preferred embodiment of the invention before the funnel is sucked down onto the pipe from which the first fluid is escaping.
Figure 3:
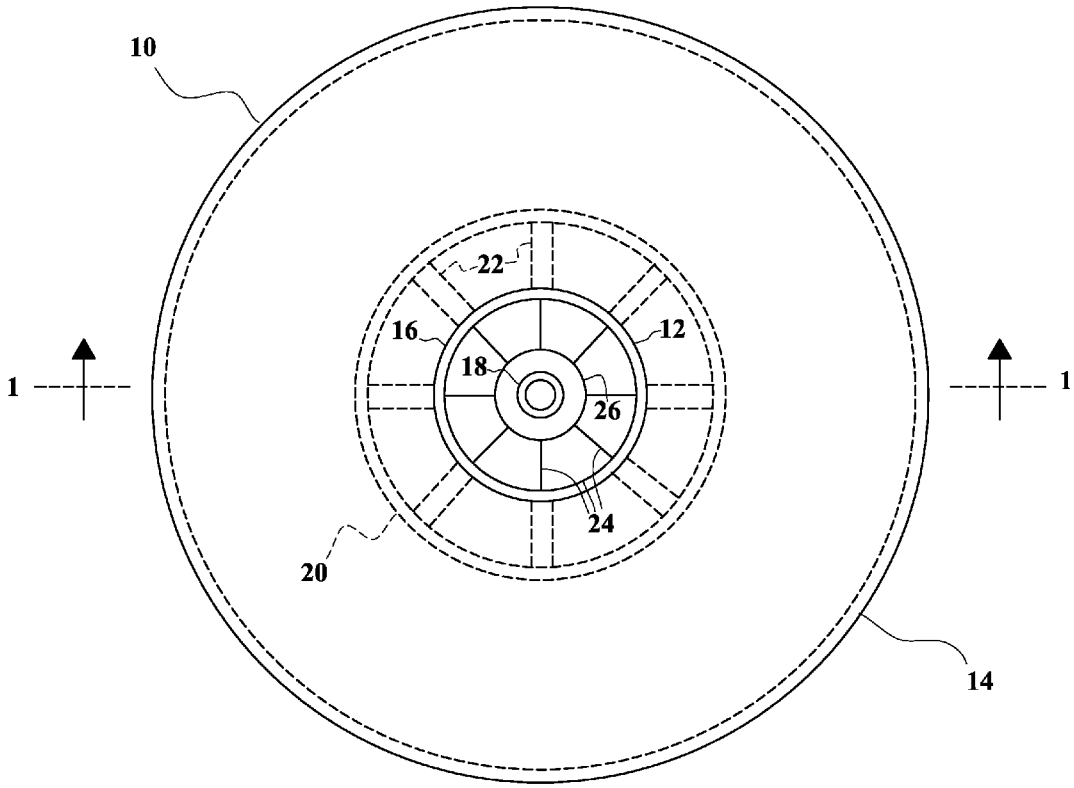
FIG. 3 is a horizontal sectional view drawn along lines 3-3 of FIG. 1, showing the first preferred embodiment of the invention.

FIG. 1 is a vertical sectional view drawn along lines 1-1 of FIG. 3, showing the first preferred embodiment of the invention before the funnel 10 is sucked down onto the pipe P (which may be a well pipe or riser) from which a first fluid (such as petroleum) is escaping. The funnel has a hollow frustoconical shape, and has a smaller end 12 and a larger end 14 that is suitably dimensioned and configured to be placed over the pipe. A return pipe 16 is connected to the smaller end of the funnel. A high pressure pipe 18 passes through the return pipe and the funnel, and is suitably dimensioned and configured to be inserted into the pipe P. A second fluid (such as air) is pumped through the high pressure pipe at a pressure greater than that of the first fluid, causing the first fluid to be separated by the second fluid in a space S adjacent to an end of the high pressure pipe that has been inserted into the pipe through which the first fluid is escaping. A portion of the first fluid that is not held back by the greater pressure of the second fluid will flow through the funnel and the return pipe at an accelerated velocity, but at a reduced pressure due to the Bernoulli effect, thus sucking the funnel down onto the pipe P.

Figure 2:
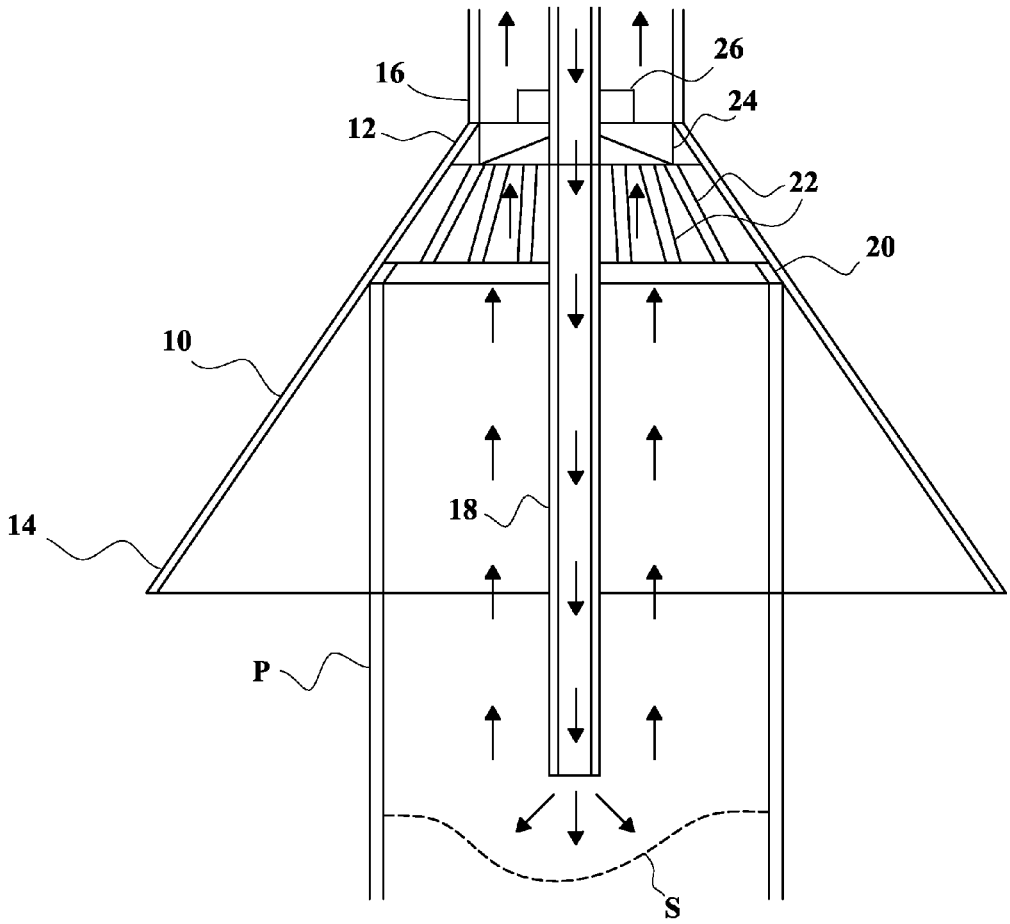
FIG. 2 is a vertical sectional view drawn along lines 1-1 of FIG. 3, showing the first preferred embodiment of the invention after the funnel is sucked down onto the pipe from which the first fluid was escaping.

FIG. 2 is a vertical sectional view drawn along lines 1-1 of FIG. 3, showing the first preferred embodiment of the invention after the funnel is sucked down onto the pipe P from which the first fluid was escaping. A gasket 20 within the funnel prevents the first and second fluids from leaking out between the funnel and the pipe P. Inside the funnel, adjacent to its smaller end, there are channels 22 to further accelerate the flow of the first and second fluids toward the return pipe. (The channels may be small pipes.) Adjacent to the smaller end of the funnel there are blades 24 driven by motor 26 that can rotate to further accelerate the flow of the first and second fluids through the return pipe. FIG. 3 is a horizontal sectional view drawn along lines 3-3 of FIG. 1, showing the first preferred embodiment of the invention.

Figure 4:
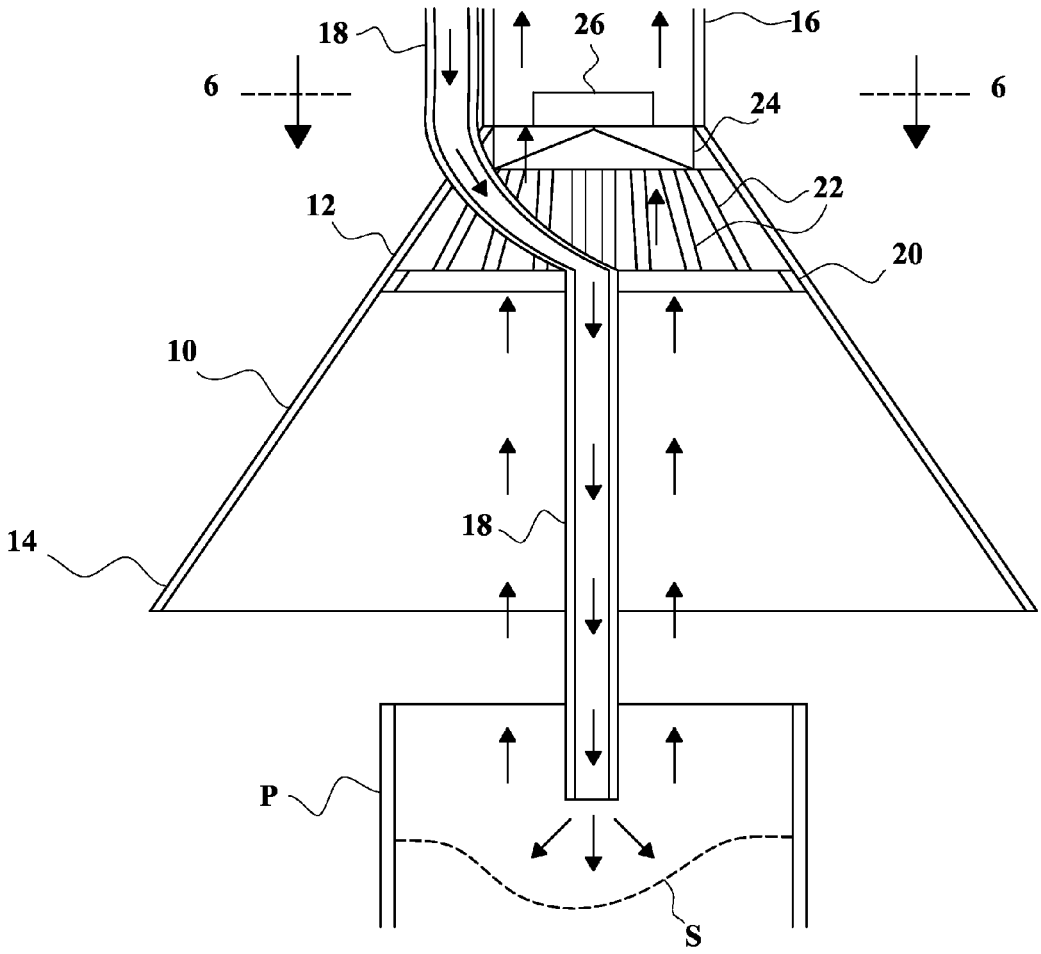
FIG. 4 is a vertical sectional view drawn along lines 4-4 of FIG. 6, showing the second preferred embodiment of the invention before the funnel is sucked down onto the pipe from which the first fluid is escaping.
Figure 5:
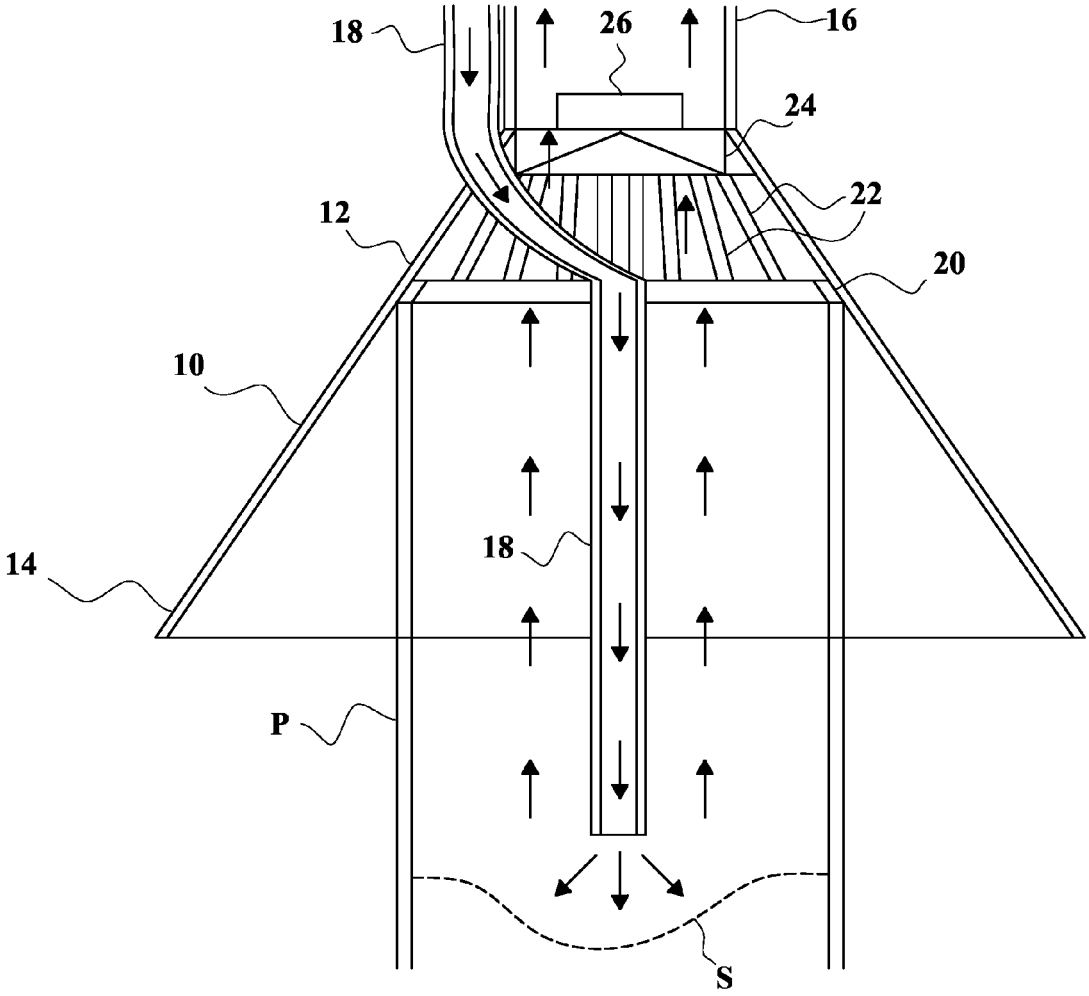
FIG. 5 is a vertical sectional view drawn along lines 4-4 of FIG. 6, showing the second preferred embodiment of the invention after the funnel is sucked down onto the pipe from which the first fluid was escaping.
Figure 6:
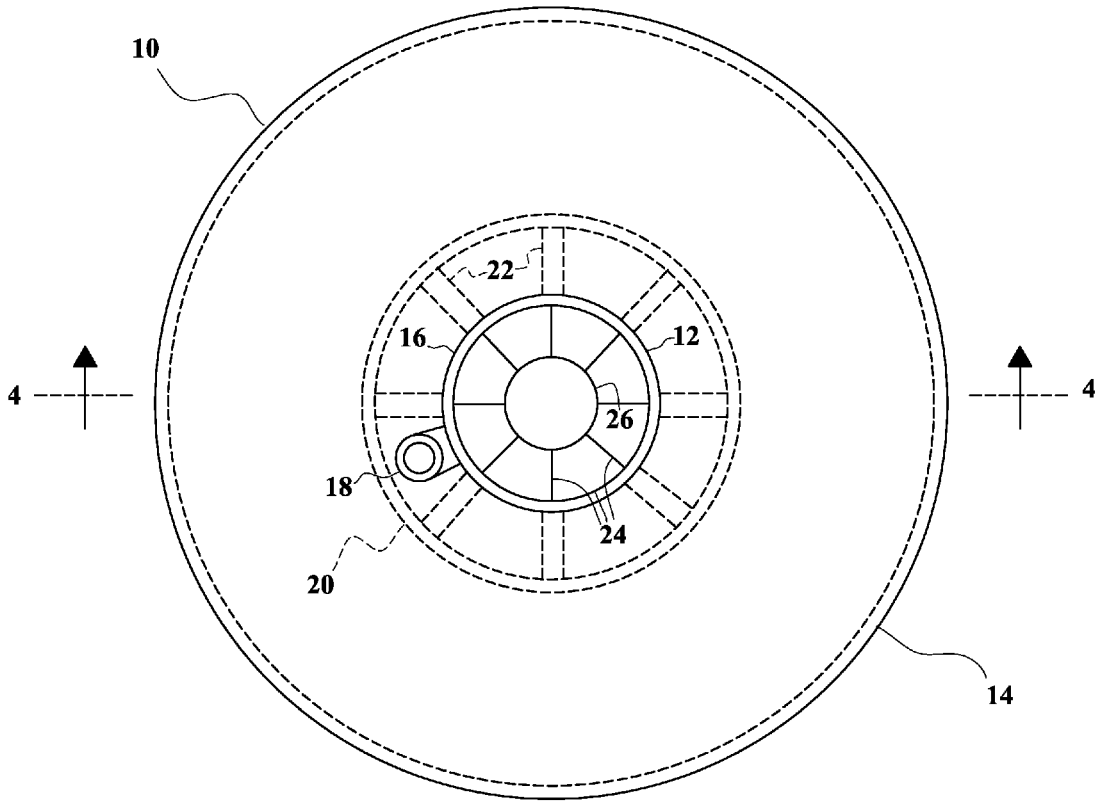
FIG. 6 is a horizontal sectional view drawn along lines 6-6 of FIG. 4, showing the second preferred embodiment of the invention.

FIG. 4 is a vertical sectional view drawn along lines 4-4 of FIG. 6, showing the second preferred embodiment of the invention before the funnel is sucked down onto the pipe from which the first fluid is escaping, which is the same as the first preferred embodiment, except that the high pressure pipe 18 is in an alternative position, passing outside the return pipe 16 and through a side of the funnel 10. FIG. 5 is a vertical sectional view drawn along lines 4-4 of FIG. 6, showing the second preferred embodiment of the invention after the funnel is sucked down onto the pipe from which the first fluid was escaping. FIG. 6 is a horizontal sectional view drawn along lines 6-6 of FIG. 4, showing the second preferred embodiment of the invention.

Figure 7:
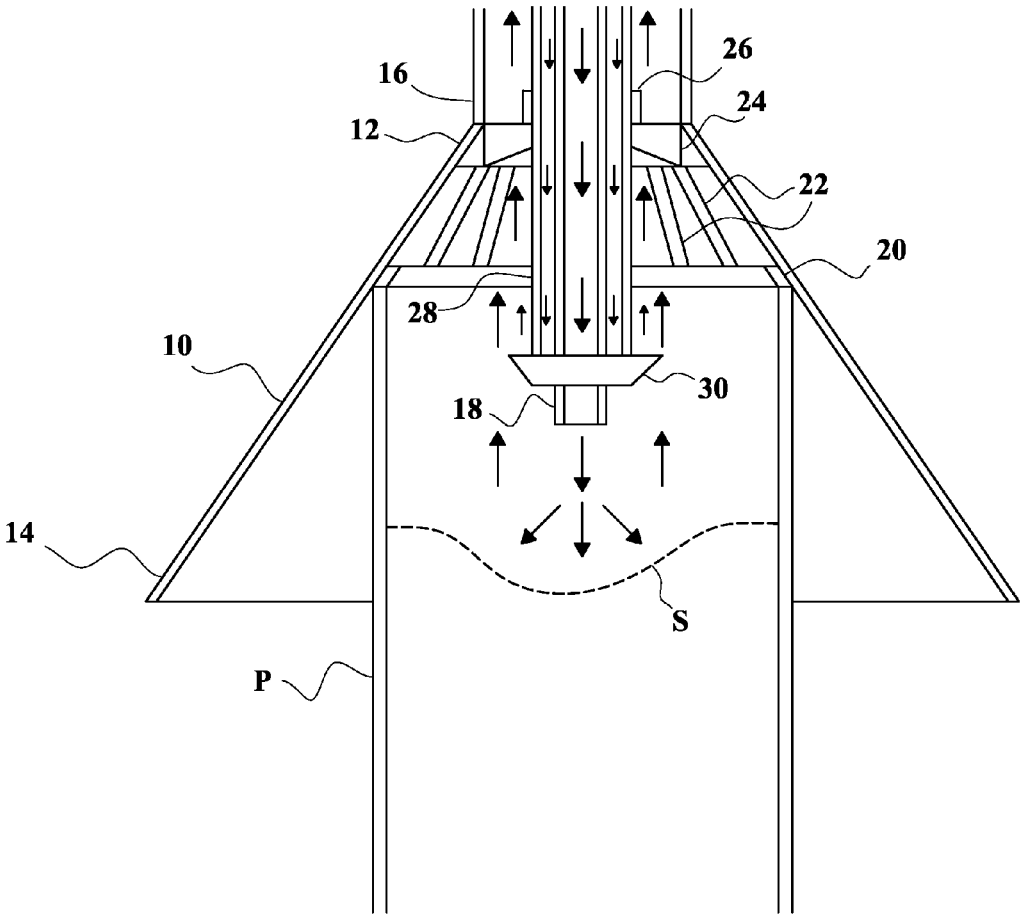
FIG. 7 is a vertical sectional view of the third preferred embodiment of the invention.

FIG. 7 is a vertical sectional view of the third preferred embodiment of the invention, in which there is a secondary air supply 28 with funnel 30, that can be used to keep the blades 24 turning if well pressure should decrease. The high pressure pipe 18 is shown retracted back up into the funnel, which is also a means of keeping the blades turning if well pressure decreases.

Figure 8:
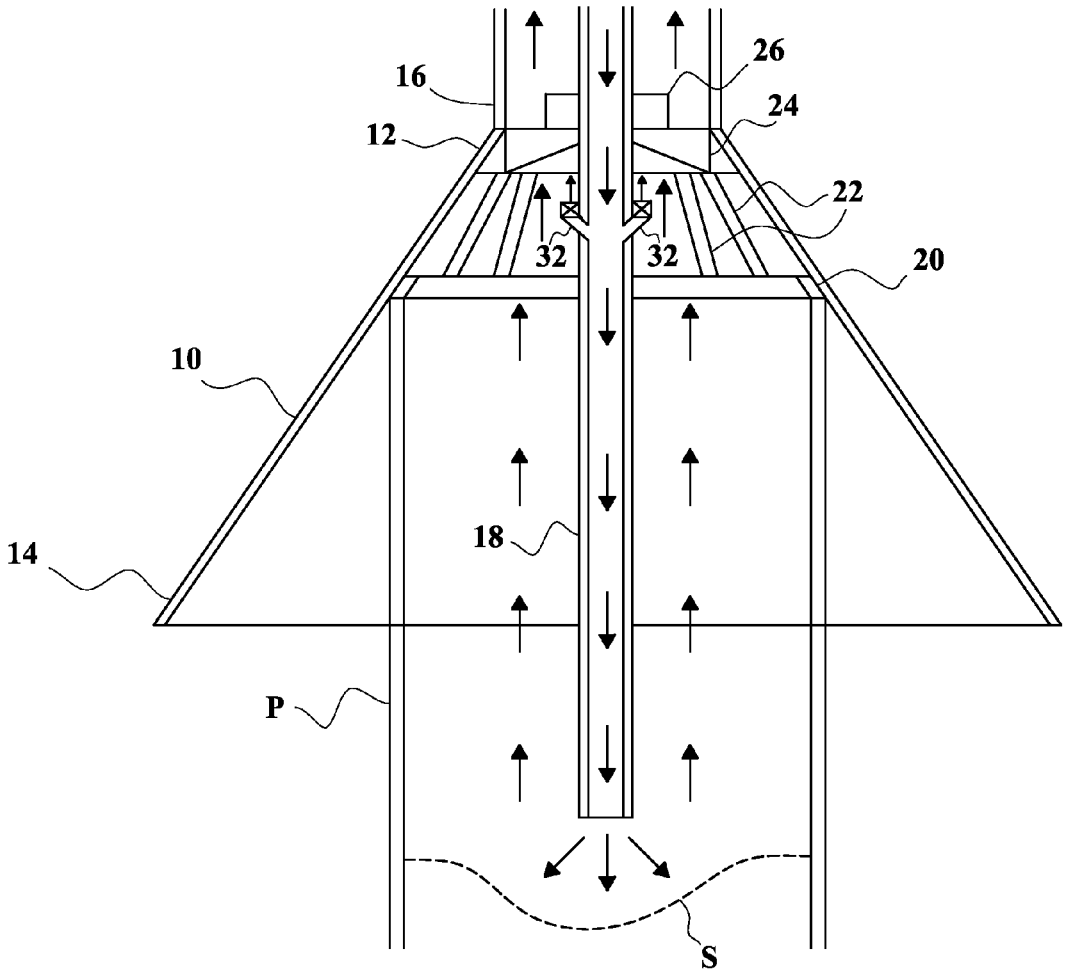
FIG. 8 is a vertical sectional view of the fourth preferred embodiment of the invention.

FIG. 8 is a vertical sectional view of the fourth preferred embodiment of the invention, in which there are valves 32 in the high pressure pipe 18 just below the blades 24 that can keep the blades turning when well pressure decreases. Note that the funnel can be sucked down both by pressure from the well, and by pressure from outside sources (that supply air to the high pressure pipe or a secondary air supply or electricity or fuel to the motor 26.)

It is to be understood that the present invention is not limited to the embodiments described above, but encompasses any and all embodiments within the scope of the following claims.

I claim:

1. A blowout preventer, comprising:

a funnel having a smaller end and a larger end, with the larger end being dimensioned and configured to be placed over an open end of a pipe through which a first fluid is escaping;

a return pipe connected to the smaller end of the funnel; and a high pressure pipe passing through the return pipe and the funnel, suitably dimensioned and configured to be insertable into the pipe through which the first fluid is escaping;

wherein, when a second fluid is pumped through the high pressure pipe at a pressure greater than that of the first fluid, the first fluid will be separated by the second fluid in a space adjacent to an end of the high pressure pipe that has been inserted into the pipe through which the first fluid is escaping, and a portion of the first fluid that is not held back by the greater pressure of the second fluid will flow through the funnel and the return pipe at an accelerated velocity, but at a reduced pressure due to the Bernoulli effect, thus sucking the funnel down onto the pipe from which the first fluid is escaping.

2. The blowout preventer according to claim 1, wherein the funnel has a hollow frustoconical shape.

3. The blowout preventer according to claim 1, wherein a gasket within the funnel prevents the first and second fluids from leaking out between the funnel and the pipe from which the first fluid is escaping.

4. The blowout preventer according to claim 1, wherein inside the funnel, adjacent to its smaller end, there are channels to further accelerate the flow of the first and second fluids toward the return pipe.

5. The blowout preventer according to claim 1, wherein adjacent to the smaller end of the funnel there are blades that can rotate to further accelerate the flow of the first and second fluids through the return pipe.

6. The blowout preventer according to claim 5, wherein there is a secondary supply of the second fluid that can accelerate the rotation of the blades.

7. The blowout preventer according to claim 5, wherein the high pressure pipe can be retracted within the funnel, making its bottom end closer to the blades and accelerating their rotation.

8. The blowout preventer according to claim 5, wherein there are valves in the high pressure pipe, below but adjacent to the blades, that can be opened to release the second fluid closer to the blades to accelerate their rotation.

9. A blowout preventer, comprising:

a funnel having a smaller end and a larger end, with the larger end being dimensioned and configured to be placed over an open end of a pipe through which a first fluid is escaping;

a return pipe connected to the smaller end of the funnel; and a high pressure pipe passing outside the return pipe and through a side of the funnel, suitably dimensioned and configured to be insertable into the pipe through which the first fluid is escaping;

wherein, when a second fluid is pumped through the high pressure pipe at a pressure greater than that of the first fluid, the first fluid will be separated by the second fluid in a space adjacent to an end of the high pressure pipe that has been inserted into the pipe through which the first fluid is escaping, and a portion of the first fluid that is not held back by the greater pressure of the second fluid will flow through the funnel and the return pipe at an accelerated velocity, but at a reduced pressure due to the Bernoulli effect, thus sucking the funnel down onto the pipe from which the first fluid is escaping.

10. The blowout preventer according to claim 9, wherein the funnel has a hollow frustoconical shape.

11. The blowout preventer according to claim 9, wherein a gasket within the funnel prevents the first and second fluids from leaking out between the funnel and the pipe from which the first fluid is escaping.

12. The blowout preventer according to claim 9, wherein inside the funnel, adjacent to its smaller end, there are channels to further accelerate the flow of the first and second fluids toward the return pipe.

13. The blowout preventer according to claim 9, wherein adjacent to the smaller end of the funnel there are blades that can rotate to further accelerate the flow of the first and second fluids through the return pipe.

14. A method of preventing blowouts, comprising the steps of:

placing a larger end of a funnel adjacent to an open end of a pipe through which a first fluid is escaping, the funnel having a smaller end that is connected to a return pipe;

inserting a high pressure pipe into the pipe through which the first fluid is escaping;

pumping a second fluid, at a higher pressure than that of the first fluid, through the high pressure pipe into the pipe through which the first fluid is escaping;

separating the first fluid by the second fluid in a space adjacent to an end of the high pressure pipe that has been inserted into the pipe through which the first fluid is escaping; and accelerating a portion of the first fluid that is not held back by the greater pressure of the second fluid, causing it to flow through the funnel and the return pipe at an increased velocity, but at a reduced pressure due to the Bernoulli effect, thus sucking the funnel down onto the pipe from which the first fluid is escaping.

15. The method of preventing blowouts according to claim 14, wherein the funnel has a hollow frustoconical shape.

16. The method of preventing blowouts according to claim 14, comprising the further step of:

preventing the first and second fluids from leaking out between the funnel and the pipe from which the first fluid is escaping, by a gasket within the funnel.

17. The method of preventing blowouts according to claim 14, comprising the further step of:

further accelerating the flow of the first and second fluids toward the return pipe, by channels inside the funnel, adjacent to its smaller end.

18. The method of preventing blowouts according to claim 14, comprising the further step of:

further accelerating the flow of the first and second fluids through the return pipe, by rotating blades adjacent to the smaller end of the funnel.

19. The method of preventing blowouts according to claim 14, wherein the high pressure pipe passes through the return pipe and the funnel.

20. The method of preventing blowouts according to claim 14, wherein the high pressure pipe passes outside the return pipe and through a side of the funnel.

* * * * *